US005706941A

United States Patent [19]

Erisoty

[11] Patent Number: 5,706,941

[45] Date of Patent: Jan. 13, 1998

[54] HAND SAW/SCABBARD ASSEMBLY AND SCABBARD THEREFOR

[75] Inventor: Gregory J. Erisoty, Riverton, Conn.

[73] Assignee: The Stanley Works, New Britain, Conn.

[21] Appl. No.: 695,625

[22] Filed: Aug. 12, 1996

[51] Int. Cl.[6] ..... A45C 11/26

[52] U.S. Cl. ..... 206/349; 206/806

[58] Field of Search ..... 206/38, 234, 306, 206/349, 372, 373, 379, 806, 446; 30/151, 162

[56] References Cited

U.S. PATENT DOCUMENTS

| | | | |
|---|---|---|---|
| 925,244 | 6/1909 | Stevenson | 206/349 |
| 1,648,565 | 11/1927 | Primley | 206/38 |
| 1,888,289 | 11/1932 | Raffles . | |
| 2,528,059 | 10/1950 | Kendrick | 30/151 |
| 3,042,087 | 7/1962 | Otoupalik . | |
| 3,837,024 | 9/1974 | Saunders . | |
| 4,061,226 | 12/1977 | Essen | 206/306 |
| 4,307,825 | 12/1981 | Pattermann . | |
| 5,092,046 | 3/1992 | Collins . | |
| 5,186,326 | 2/1993 | Peckels et al. | 206/234 |
| 5,213,207 | 5/1993 | Konev | 206/349 |
| 5,263,584 | 11/1993 | Sevey | 206/349 |
| 5,363,957 | 11/1994 | Reichner | 206/349 |
| 5,379,520 | 1/1995 | Collins . | |
| 5,533,617 | 7/1996 | Von Flatern | 206/446 |

*Primary Examiner*—David T. Fidei
*Attorney, Agent, or Firm*—Pepe & Hazard

[57] ABSTRACT

A hand saw scabbard seats the saw blade of the hand saw with the handle at one end abutting its open end. The elongated molded scabbard has a generally rectangular cross section formed by spaced face walls and relatively short side walls extending therebetween and an end wall at one end thereof. The other end of the housing is open to provide the entrance into the cavity which is dimensioned to seat the saw blade. The inner surface of at least one of the face walls has integrally formed bosses thereon which bear upon the surface of the saw blade seated in the cavity to frictionally retain it.

14 Claims, 2 Drawing Sheets

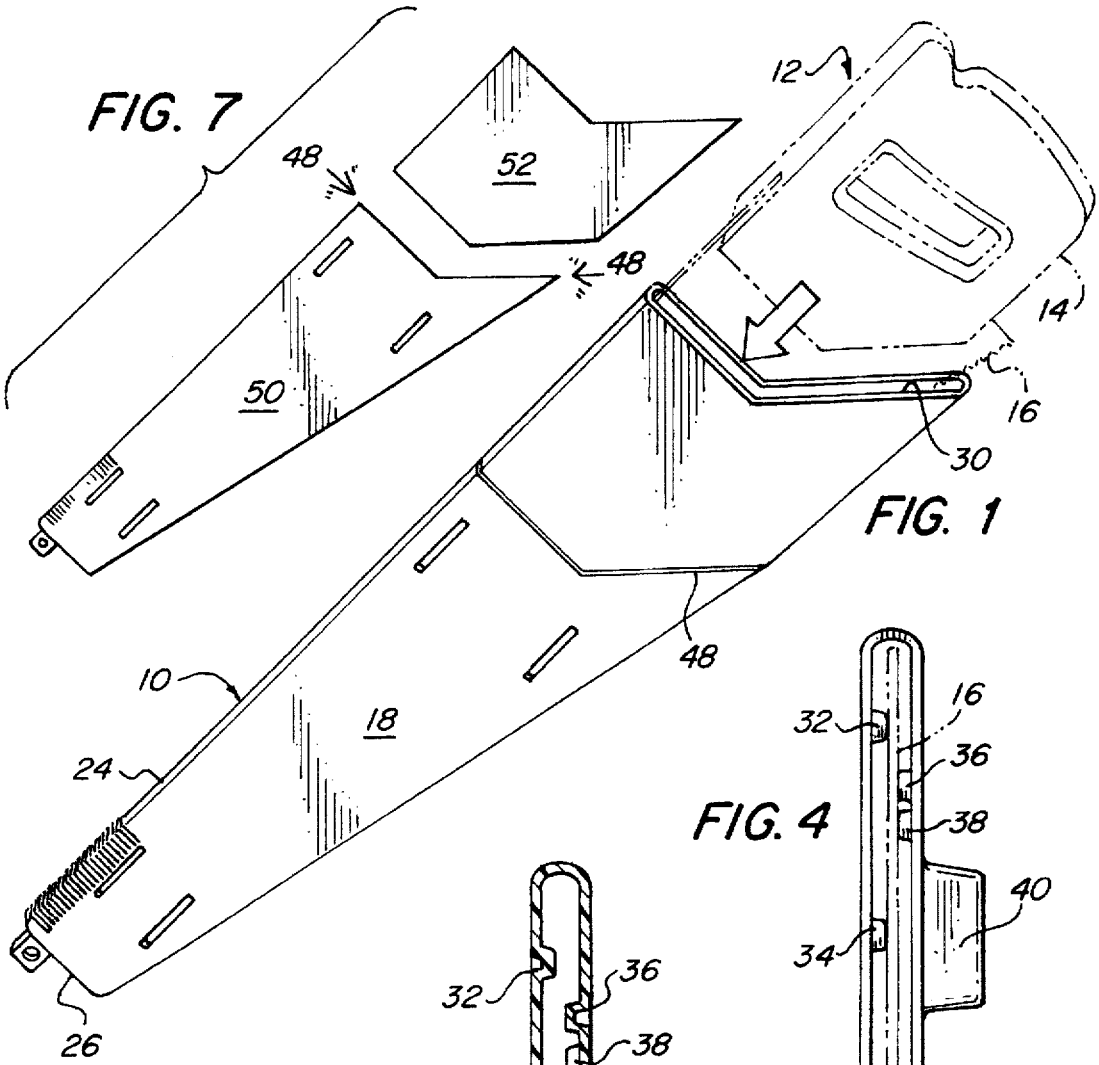
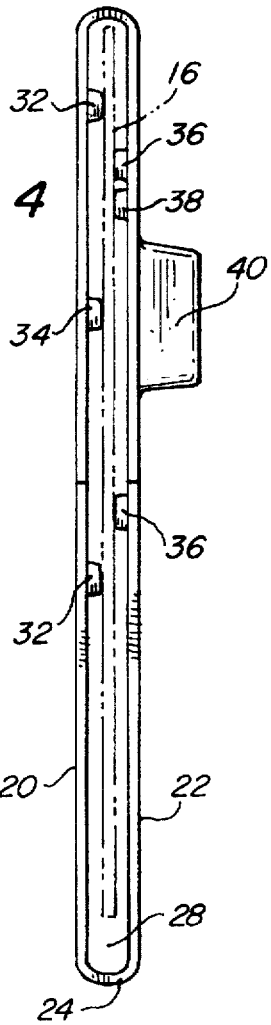
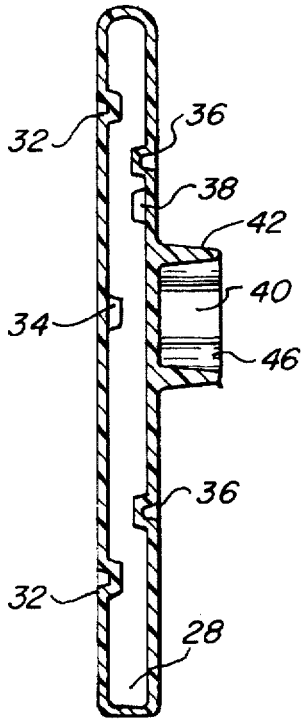
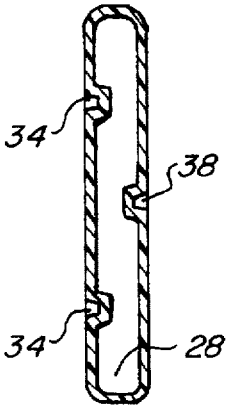
FIG. 6
FIG. 5

HAND SAW/SCABBARD ASSEMBLY AND SCABBARD THEREFOR

BACKGROUND OF THE INVENTION

The present invention relates to scabbards or sheaths for tools having sharp edges, and, more particularly, to a scabbard for a hand saw.

Scabbards or sheaths are widely employed to seat the metal blades of knives, saws and other tools having sharp edges to protect the blades from damage by nicking or contact with other objects, or corrosion. Furthermore, scabbards serve to protect people from coming in contact with the sharp blade and accidental injury.

A variety of devices have been developed to retain saw blades within scabbards such as clips, snaps, straps and spring loaded detents. However, these devices are often subject to breakage due to undergoing extremely rough usage, such as being tossed repetitively into tool boxes or upon the ground.

Yet another drawback to standard scabbards is that they are often designed to fit blades of a specific length or design. This limits the functional adaptability of saw blade scabbards and requires multiple sizes of scabbards to be manufactured and inventoried in order to fit a variety of blade sizes.

Accordingly, it is an object of the present invention to provide a novel molded saw blade scabbard assembly in which the blade is securely retained by frictional engagement.

It is also an object to provide such a scabbard which may fit a multiplicity of saw blade sizes by easily cutting it to the desired length.

Yet another object is to provide such a scabbard which may be readily fabricated from synthetic resin to produce a long lasting, rugged housing.

SUMMARY OF THE INVENTION

It has now been found that the foregoing and related objects may be readily attained in a scabbard for a hand saw having a saw blade with a handle at one end. The scabbard comprises an elongated molded housing of rectangular cross section formed by spaced face walls and relatively short side walls extending therebetween and an end wall at one end. The other end of the housing is open to provide an entrance into the cavity, which is dimensioned to seat the saw blade. The inner surface of at least one of the face walls has integrally formed bosses thereon which bear upon the surface of the saw blade seated in the cavity to frictionally retain it.

Preferably, both of the face walls have bosses on their inner surfaces. These bosses are elongated and extend generally parallel to each other, and the bosses on one face wall are transversely offset from those on the other face wall.

Generally, the housing has cutting guide means on its outer surface adjacent its other end to facilitate cutting the housing across its width. This reduces its length to accommodate a hand saw with a saw blade of shorter length. The cutting guide means generally provides a reduced thickness for the housing therealong.

Desirably, the housing has a V-shaped configuration at its open other end against which the saw handle abuts. Preferably, one of the face walls of the housing has an elongated receptacle on its outer surface to provide a pocket for seating a pencil or the like. This receptacle has side and end walls, and the side walls have bosses on their inner surfaces and are deflectable to frictionally engage a pencil seated therein.

Desirably, the housing includes an apertured ear projecting from its end wall for hanging the scabbard thereby.

BRIEF DESCRIPTION OF THE DRAWINGS

FIG. 1 is a perspective view of a saw blade scabbard embodying the present invention and showing portions of a hand saw in phantom line with an arrow indicating the movement of the saw being inserted into the scabbard;

FIG. 4 is an elevational view of the handle end of the scabbard drawn to a greatly enlarged scale;

FIG. 5 is a sectional view of the scabbard along the line 5—5 of FIG. 3;

FIG. 6 is a sectional view of the scabbard along the line 6—6 of FIG. 3; and

FIG. 7 is an view of the scabbard after cutting to shorten its length.

DETAILED DESCRIPTION OF THE PREFERRED EMBODIMENT

Turning first to FIG. 1, therein illustrated is a saw blade scabbard embodying the present invention generally designated by the numeral 10 which seats protectively within it the saw blade 16 of a hand saw generally designated by the numeral 12.

Figure 2:
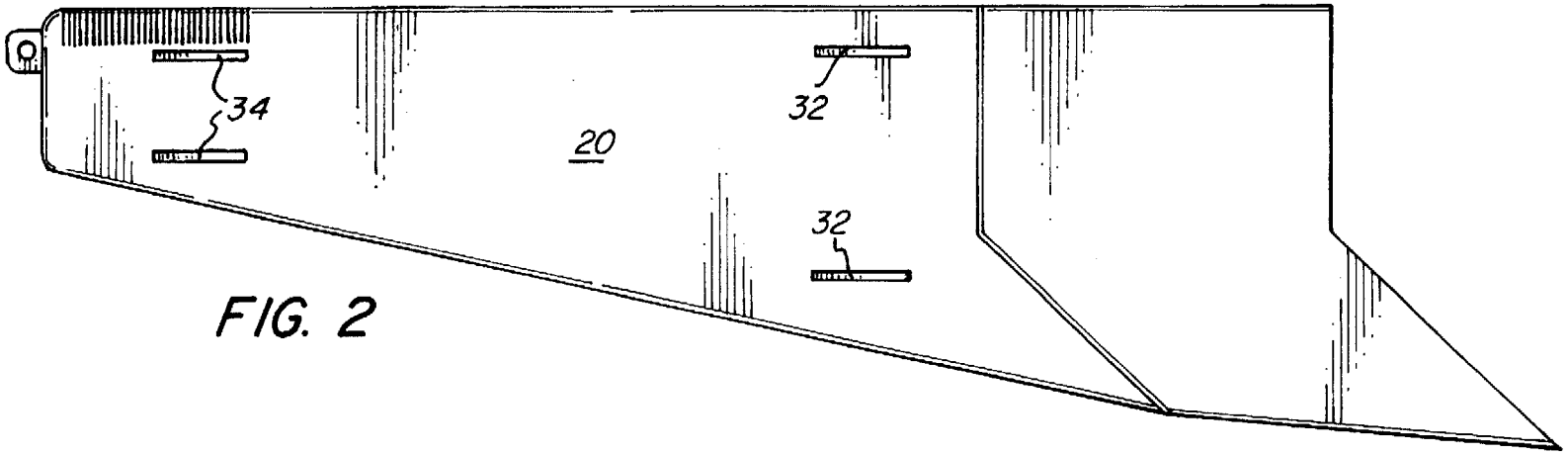
FIG. 2 is a side elevational view of the scabbard of FIG. 1.
Figure 3:
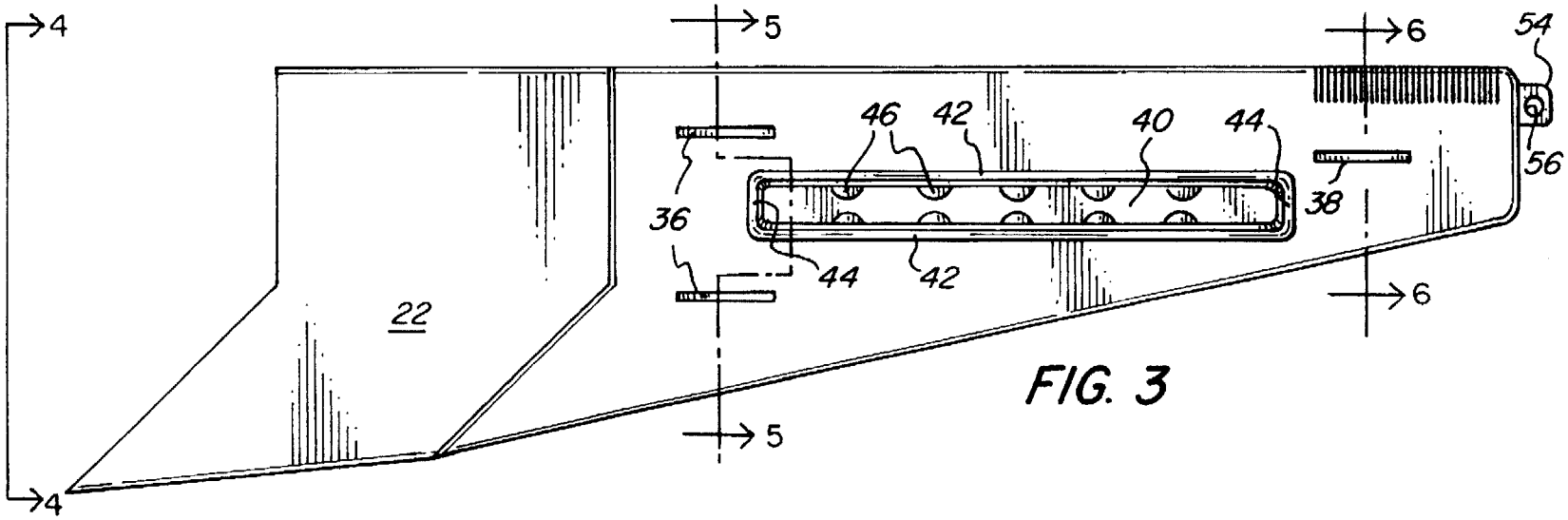
FIG. 3 is a side elevational view of the opposite side of the scabbard.

The scabbard 10 is a unitary elongated molded housing having a generally rectangular cross section as illustrated in FIGS. 4–6. The scabbard 10 has a pair of spaced face walls 20, 22 as illustrated in FIGS. 2 and 3 respectively, and relatively short side walls 24 extending therebetween as illustrated in FIGS. 1 and 4–6. These walls 20, 22, 24 define a cavity 28 which accommodates the blade 16 of the hand saw 12 as best illustrated in FIG. 4. The scabbard 10 tapers to a reduced width at one end which is closed by the end wall 26, and its other end is open to provide an entrance 30 through which the blade is inserted into the cavity 28 as indicated by the arrow in FIG. 1.

Each face wall 20, 22 has a multiplicity of integrally formed bosses 32, 34 and 36, 38 on its inner surface to bear upon the surface of saw blade 16 seated in the cavity 28 and frictionally retain the blade 16 therein. The bosses 32, 34, 36, 38 are elongated and extend parallel to each other along the longitudinal axis of the scabbard housing 18. The bosses 32 and 34 on the face wall 20 are transversely offset from the bosses 36 and 38 on the opposite face wall 22, and the bosses 32, 34, 36, 38 are dimensioned so that the distance between planes defined by their inner surfaces is slightly less than the thickness of the blade 16. In addition, the bosses 34, 38 and 32, 36 are spaced against the closed end 26 and open end 30 of the scabbard 10 respectively to frictionally engage the saw blade 16 adjacent its ends.

The benefit of this configuration is that each boss 32, 34, 36, 38 provides an individual bearing point along the length and width of the saw blade 16 at which it is frictionally engaged and reduces the number of bosses 32–38 required for effective retention.

As illustrated in FIGS. 3 and 4, the outer surface of the face wall 22 is formed with an elongated rectangular pencil pocket 40 defined by a pair of side walls 42 extending along the longitudinal axis of the scabbard 10 and a pair of end walls 44 extending transversely therebetween. The side walls 42 have opposing semicylindrical bosses 46 spaced along their inner surfaces which are resiliently deflectable to engage and retain a pencil or the like (not shown) seated within the pocket 40.

As seen in FIGS. 1–3, the illustrated embodiment includes an ear 54 with aperture 56 therein at the closed end 26 of the housing 18 which permits the scabbard 10 to be hung in a vertical position with the handle 14 of the hand saw 12 pointed downwardly.

As illustrated in FIGS. 1–3 and 7, the open end 30 of the scabbard 10 has a V-shaped configuration against which the shoulder of the hand saw handle 14 abuts. In addition, the cavity 30 in the scabbard 10 is dimensioned to seat the saw blade 16 snugly to restrict the movement of the saw blade 16 therewithin.

For saw blades of smaller length, the scabbard 10 may be conveniently cut along one or more score lines 48 adjacent the open end 30 to reduce its length. The score line 48 facilitates the cutting of the housing 18 across its width because it provides a reduced thickness in the wall of the scabbard 10 and guides a cutting tool. As illustrated in FIG. 7, this process results in a shortened scabbard portion 50 and a severed end portion 52 which is discarded. Once the housing 18 is cut to form the shortened scabbard 50, the location of the score line 48 becomes the new blade entrance 30. Accordingly, the score line 48 has a V-shaped configuration similar to that of the entrance end 30 to provide an abutment for the handle 14 of the hand saw 12.

As will be appreciated, various resins may be employed for the construction of the scabbard to provide the desired lightweight resiliency over a broad temperature range and durability. Conveniently, the scabbard is blow molded from polypropylene or polyethylene.

Thus, it can be seen from the foregoing detailed description and accompanying drawings that the novel saw blade scabbard of the present invention is one which effectively frictionally retains saw blades and which may be readily cut across its width to reduce its length to accommodate saw blades of shorter length. The scabbard may be readily and economically fabricated in different configurations and dimensions for a large variety of saw blades.

What is claim is:

1. A hand saw/scabbard assembly comprising a hand saw with a saw blade and handle at one end thereof, and a hand saw scabbard assembly in which said saw blade is seated, said scabbard comprising an elongated integrally molded synthetic resin housing of generally rectangular cross section with spaced, substantially planar face walls and relatively short side walls extending therebetween and an end wall at one end thereof, the other end being open and providing an entrance into a cavity therewithin of generally rectangular cross section, said housing being dimensioned to seat said saw blade snugly therewithin, said cavity cross section being of larger transverse dimension adjacent said other end of said housing than that adjacent said one end the inner surface of at least one of said face walls having integrally formed bosses thereon bearing upon the surface of said saw blade seated in said cavity to provide frictional retention thereof with said cavity.

2. The hand saw/scabbard assembly in accordance with claim 1 wherein both of said face walls have bosses on their inner surfaces bearing upon opposite surfaces of said saw blade.

3. The hand saw scabbard assembly in accordance with claim 2 wherein said bosses on said face walls are elongated and extend generally parallel to each other.

4. The hand saw scabbard assembly in accordance with claim 2 wherein the bosses on one face wall are transversely offset from those on the other face wall.

5. The hand saw scabbard assembly in accordance with claim 1 wherein said housing has cutting guide means on its outer surface adjacent said other end thereof to facilitate cutting said housing across its width to reduce its length to accommodate a hand saw with a saw blade of shorter length.

6. The hand saw scabbard assembly in accordance with claim 5 wherein said cutting guide means provides a reduced thickness of the housing therealong.

7. The hand saw scabbard assembly in accordance with claim 1 wherein said housing has a generally V-shaped configuration at said other end against which the handle of the saw abuts.

8. The hand saw scabbard assembly in accordance with claim 1 wherein one of said face walls of said housing has an elongated receptacle on its outer surface to provide a pocket for seating a pencil.

9. The hand saw scabbard assembly in accordance with claim 8 wherein said receptacle has side and end walls and said side walls have bosses on their inner surfaces, said side walls of said receptacle being deflectable to frictionally engage a pencil seated therein.

10. The hand saw scabbard assembly in accordance with claim 1 wherein said housing includes an apertured ear projecting from said end wall for hanging said scabbard thereby.

11. A scabbard for a hand saw having a saw blade with handle at one end thereof, said scabbard comprising an elongated molded housing of generally rectangular cross section with spaced face walls and relatively short side walls extending therebetween and an end wall at one end thereof, the other end being open and providing an entrance into the cavity therewithin, said housing being dimensioned to seat the saw blade therewithin, the inner surface of both of said face walls having integrally formed bosses thereon adapted to bear upon the surface of a saw blade seated in said cavity to provide frictional retention thereof, said bosses on one face wall being transversely offset from those on the other face wall.

12. A scabbard for a hand saw having a saw blade with handle at one end thereof, said scabbard comprising an elongated molded housing of generally rectangular cross section with spaced face walls and relatively short side walls extending therebetween and an end wall at one end thereof, the other end being open and providing an entrance into the cavity therewithin, said housing being dimensioned to seat the saw blade therewithin, the inner surface of at least one of said face walls having integrally formed bosses thereon adapted to bear upon the surface of a saw blade seated in said cavity to provide frictional retention thereof, said housing having cutting guide means on its outer surface adjacent said other end thereof to facilitate cutting said housing across its width to reduce its length to accommodate a hand saw with a saw blade of shorter length.

13. The scabbard in accordance with claim 12 wherein said cutting guide means provides a reduced thickness of the housing therealong.

14. A scabbard for a hand saw having a saw blade with handle at one end thereof, said scabbard comprising an elongated molded housing of generally rectangular cross section with spaced face walls and relatively short side walls extending therebetween and an end wall at one end thereof, the other end being open and providing an entrance into the cavity therewithin, said housing being dimensioned to seat the saw blade therewithin, the inner surface of at least one of said face walls having integrally formed bosses thereon adapted to bear upon the surface of a saw blade seated in said cavity to provide frictional retention thereof, one of said face walls of said housing having an elongated receptacle on its outer surface to provide a pocket for seating a pencil, said side walls of said receptacle being deflectable to frictionally engage a pencil seated therein.

* * * * *